United States Patent [19]

Loftin

[11] 4,171,706

[45] Oct. 23, 1979

[54] METHOD FOR SIPHONING WATER FROM A PONDING AREA ON A FLAT ROOF

[76] Inventor: Douglas W. Loftin, 15 Warren Dr., Little Rock, Ark. 72209

[21] Appl. No.: 841,601

[22] Filed: Oct. 12, 1977

[51] Int. Cl.[2] ..... F04F 10/02

[52] U.S. Cl. ..... 137/1; 137/142

[58] Field of Search ..... 137/1, 128, 140, 142, 137/357; 52/16

[56] References Cited

U.S. PATENT DOCUMENTS

| | | | |
|---|---|---|---|
| Re. 28,491 | 7/1975 | Kundert | 137/142 |
| 831,817 | 9/1906 | Ackley . | |
| 2,307,324 | 1/1943 | Larson | 137/357 X |
| 2,313,855 | 3/1943 | Wiggins . | |
| 3,757,812 | 9/1973 | Duncan | 137/142 |
| 4,059,126 | 11/1977 | Nickerson | 137/142 |

*Primary Examiner*—Gerald A. Michalsky

*Attorney, Agent, or Firm*—Cushman, Darby & Cushman

[57] ABSTRACT

A method for removing water from a ponding area of a flat roof having a run-off system which is no longer operable to drain water from the ponding area which comprises directing a quantity of the run-off water flow in the run-off system as a result of the commencement of a rain condition or the like into a priming chamber from which run-off water is allowed to discharge into the run-off system at a rate less than the rate of flow of run-off water into the priming chamber and effecting a siphoning action as a result of the diminishing of the flow of run-off water in the run-off system as by the cessation of the rain condition so that the quantity of run-off water flowing into the priming chamber is less than the quantity flowing out thereby lowering the water level within the priming chamber and creating a suction action which is utilized to commence the movement of the water in the ponding area through the siphon device hose which movement continues until all of the water in the ponding area has been sucked up through the siphon hose.

4 Claims, 5 Drawing Figures

METHOD FOR SIPHONING WATER FROM A PONDING AREA ON A FLAT ROOF

This invention relates to the handling of water on flat roofs and more particularly to an improved method for siphoning water from a ponding area on a flat roof.

While a pitched roof is the construction usually adopted in relatively small building constructions, such as dwellings and the like, flat roof constructions are usually employed in larger buildings where the roof extends over a greater area. Roof constructions of this type are provided with a water run-off system. These systems all provide one or more downspouts or ducts which serve to carry the run-off water from the level of the roof to a level below where it can be disposed of. The downspout in many instances forms a part of a gutter along one peripheral edge of the roof but is more frequently built into the central portion of the roof and extends downwardly alongside of a vertical support or column of the building. In either event, the situation presented is such that the downspout is provided in a position of roof support, either at the exterior wall, as in the case of the gutter construction, or at the column in the case of the interior downspout construction.

Experience has shown that any tendency for flat roof constructions to settle or sag almost invariably results in the creation of areas on the flat roof spaced from the supports and downspouts which are lower than the areas where the roof is supported. These lower areas become ponding areas when a rain condition commences. Once these ponding areas are established, they tend to increase and have a deleterious snowballing effect on the roof. To some extent the weight of the ponding water is added to the roof at a position where the greatest sag occurs. The additional weight causes additional sag, and additional sag increases the size of the ponding areas, etc. Moreover, the existence of standing water on a roof induces thermal stresses which can cause blistering, cracking and leaking which leads to premature roof failure. The reason for this thermal stress is that, after a rain when the sun is again directly shining on the roof, the areas of the roof surrounding the ponding area which are not in contact with the ponding water become quite hot, while the adjacent areas of the roof beneath the peripheral areas of the standing water are in an evaporative cooling condition. Thus, there is established periodically occurring local thermal expansion and contraction which induces stresses which would not otherwise be applied in the absence of the ponding water.

While the above-described ponding problem is well known, the solutions presently practiced are all quite expensive. Among the most expensive solutions is to re-finish the roofing surface so as to level out the low spots which provide the ponding areas. Another effort has been to provide pumps operable to remove ponding water by a pumping action. Examples of prior art of this nature are found in the following U.S. Pat. Nos. 831,817; 2,313,855; 3,757,812; and Re. 28,491. In general it can be stated that the available pumping systems are likewise expensive and somewhat costly to operate and maintain. In recent months a solar powered roof drain pump has been made commercially available by B. F. Goodrich. This pump is operated by solar energy and the sun's heat is used to prime the pump. Notwithstanding the efforts to date, there still is a need for an effective solution to the ponding problem which is more economical than the solutions heretofore provided.

An object of the present invention is to fulfill the above described need. In accordance with the principles of the present invention, this objective is obtained by a method in which a portion of the run-off water when flowing in the run-off system is utilized to prime a siphon device and the water from the ponding area is siphoned therefrom with the siphon device so primed. Preferably, the priming operation is accomplished by directing a quantity of the run-off water flowing in the run-off system into a priming chamber from which run-off water is allowed to discharge into the run-off system at a rate less than the rate of flow of run-off water into the priming chamber. The siphoning action takes place as a result of the diminishing of the flow of run-off water in the run-off system so that the quantity of run-off water flowing into the priming chamber is less than the quantity flowing out thereby lowering the water level within the priming chamber and creating a suction action which is utilized to commence the movement of water in the ponding area through the siphon device hose, which movement continues until all of the water in the ponding area has been sucked up through the siphon hose.

In accordance with the principles of the present invention, there is also provided a device for carrying out the above-described method which includes a priming chamber adapted to be mounted within the existing water run-off system of the roof so as to be operable due to the flow of run-off water in the run-off system as by the commencement of a rain condition or the like, to communicate run-off water with the priming chamber sufficient to establish a rising water level condition with respect to the priming chamber. The arrangement also provides for the establishment of a falling water level condition with respect to the priming chamber due to the flow reduction of water in the run-off system as a result of the cessation of the rain condition. The device also includes a siphon hose communicating with the priming chamber and adapted to be communicated in water sucking relation with respect to the ponding area on the roof to be drained. When the rising water level condition is established with respect to the primary chamber, air is allowed to be displaced from the priming chamber by water displacement into the priming chamber. When the rain condition is over and a falling water level condition is established with respect to the priming chamber, the effect is to reduce the pressure of the air within the priming chamber and the communicating hose by water displacement out of the priming chamber. This reduction in air pressure is sufficient to effect the flow of water from the ponding area through the hose, which flow continues by a siphoning action until all of the water is sucked from the ponding area.

Preferably, the pump device constitites essentially a static structure and contains a minimum of moving parts. With this preferred construction the rising and falling water level conditions are established by providing inlet openings for the priming chamber which have a flow capacity greater than the outlet opening or openings provided for the priming chamber. In this way, when a water flow is available in the run-off system as a result of the commencement of a rain condition, at least a portion of the available water is directed to the inlet openings for the priming chamber. Since the amount of water available to enter the priming chamber through the inlet opening is greater than the amount of water which can leave the priming chamber through the outlet opening, a rising water level condition is established. Conversely, when the flow of water in the run-off system is reduced, as by the cessation of rain condition, the amount of water available to enter the priming chamber through the inlet opening is less than the amount of water that can leave the priming chamber through the outlet opening, thereby establishing a falling water level condition. In order to effect the displacement of the air from the priming chamber by water displacement in response to the establishment of the rising water level condition, it is preferable to provide a check valve air vent which communicates with the upper end of the priming chamber. This check valve vent allows air to be displaced out of the priming chamber but does not permit the flow of air into the priming chamber. Consequently, when a reduction in the pressure of the air occurs by water displacement out of the priming chamber in response to the establishment of a falling water level condition, such reduction in air pressure when communicated with the hose, will serve to suck the water in the ponding area through the hose, which water is preferably discharged into the priming chamber from which it leaves through the outlet opening thereof. The outlet opening is preferably in the bottom of the priming chamber so that the entire priming chamber and outlet opening are self-draining after the pump has accomplished its function of sucking up the water in the ponding area.

These and other objects of the present invention will become more apparent during the course of the following detailed description and appended claims.

The invention may best be understood with reference to the accompanying drawings, wherein illustrative embodiments are shown.

Figure 3:
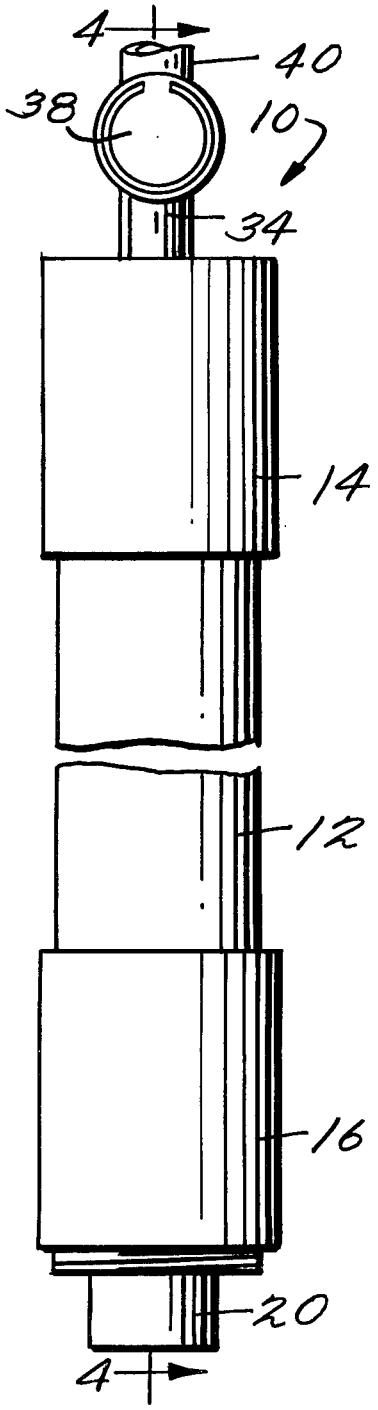
FIG. 3 is a front elevational view of the device with a portion of the siphon hose cut off.
Figure 4:
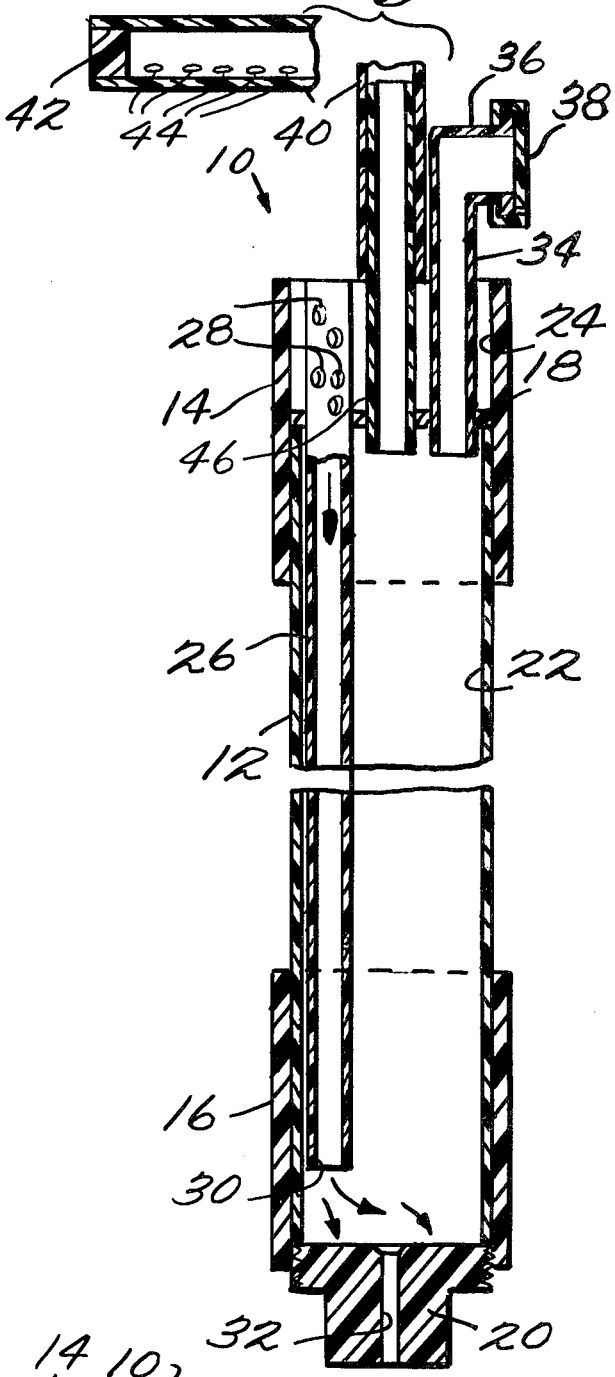
FIG. 4 is a sectional view taken along the line 4—4 of FIG. 3.
Figure 5:
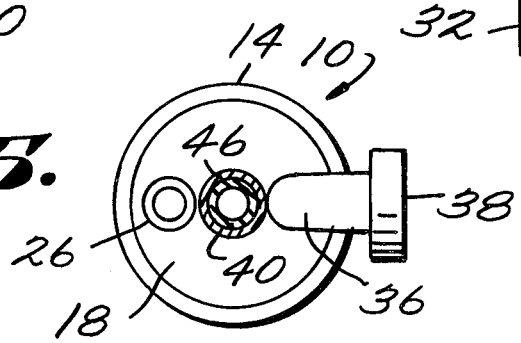
FIG. 5 is a top plan view of the device shown in FIG. 3.

Referring now more particularly to FIGS. 3–5 of the drawings, there is shown therein a device for siphoning water from a ponding area on a flat roof, generally indicated by the numeral 10, which embodies the principles of the present invention. The device includes a tubular housing formed of a central elongated tube 12 having an upper tubular sleeve 14 fixed to the upper end thereof and a lower tubular sleeve 16 fixed to the lower end thereof. As shown, the upper sleeve 14 extends above the upper end of the central tube 12 and has a partition wall 18 fixedly secured therein in exterior peripheral sealing engagement with the central interior periphery of the sleeve and in end edge sealing engagement with the upper end of the central tube 12. The lower sleeve 16 is interiorly peripherally secured to the exterior periphery of the central tube 12 and includes a lower end portion extending below the lower edge of the central tube 12.

Mounted within the lower end of the lower sleeve 16 is an end closure member 20. As shown, the end closure member 20 has an exterior threaded connection with the interior of the lower end of the sleeve 16 and provides an interior engagement with the lower edge of the central tube 12.

The inner periphery of the central tube 12 between the upper partition wall 18 and the lower closure member 20 defines a priming chamber 22. The interior periphery of the portion of the upper sleeve 14 extending above the upper partition wall 18 defines with the upper surface of the latter a run-off water receiving chamber 24 having an open upper end. Inlet opening means is provided between the water receiving chamber 24 and the priming chamber 22. As shown, the inlet opening means is preferably in the form of an inlet tube 26 which is exteriorly peripherally secured in sealing relation with the upper partition wall 18. The inlet tube includes an upper inlet portion extending above the upper partition wall 18 into the water receiving chamber 24, which upper portion is provided with a plurality of inlet openings 28 in the peripheral wall thereof. It will be noted that some of the openings extend through the wall of the inlet tube at the level of the partition wall 18 while some are spaced thereabove. The total cross-sectional area of all of the openings 28 is preferably greater than the cross-sectional area of the inlet tube 26.

It will be noted that the major portion of the inlet tube 26 extends downwardly from the upper partition wall 18 into the priming chamber 22 and has its lower end open as indicated at 30 at a position spaced slightly above the end closure 20. The end closure 20 has an outlet opening 32 extending centrally therethrough, the cross-sectional area of which is less than the cross-sectional area of the inlet tube 26. An exemplary illustration of the size relationship between the inlet opening 30 and outlet opening 32 is one in which both cross-sections are circular with the inlet cross-section having a diameter of approximately ½" while the diameter of the outlet opening 32 is approximately ¼".

The device 10 also includes an air vent tube 34 which is exteriorly peripherally secured in sealing relation with the upper partition wall 18. The vent tube has its lower interior end communicating with the upper end portion of the priming chamber 22 and includes a bent-over upper end portion 36 within which is mounted a check valve assembly 38. The check valve assembly 38 may be of any suitable construction and, as shown, consists essentially of a simple flap valve member which will permit flow of air outwardly from the priming chamber 22 through the vent tube, but will prevent flow of air inwardly into the vent tube.

The device 10 also includes a length of siphon hose 40. As best shown in FIG. 4, a free end of the siphon hose 40 has a plug 42 fixedly secured within the extremity thereof as by cement or the like. Formed along one side of the peripheral wall adjacent the plug 42 is a series of inlet openings 44. The inlet openings 44 are thus positioned so that the free end portion of the hose 40 can be simply rested upon a ponding surface area of the roof, so that when a rain condition occurs the build-up of the water in the ponding area will cover the openings 44.

The opposite end of the hose 40 is fixedly connected in interior communicating relation with the priming chamber 22. Preferably this communication is accomplished by means of a central nipple 46 which has its exterior periphery sealingly secured to the central portion of the upper partition wall 18. The main portion of the nipple 46 extends upwardly above the partition wall 18 and has its exterior periphery adapted to receive the interior periphery of the other end portion of the hose 40. The connection is preferably made secure by means of suitable cement between the exterior periphery of the nipple and the interior periphery of the hose.

It will be understood that the various components of the device 10 described above may be formed of any suitable material. However, a preferred arrangement is to form all of the parts of plastic material.

METHOD AND OPERATION

Figure 1:
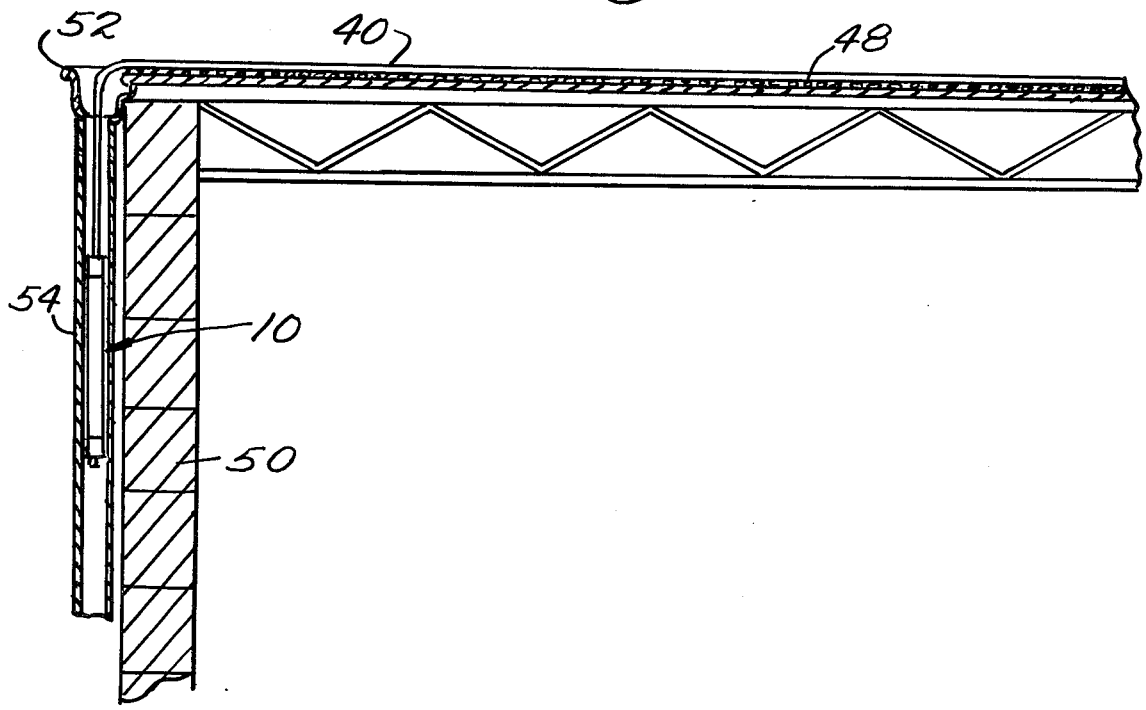
FIG. 1 is a vertical sectional view of a flat roof construction having a side wall gutter and downspout water run-off system showing the device of the present invention installed therein.
Figure 2:
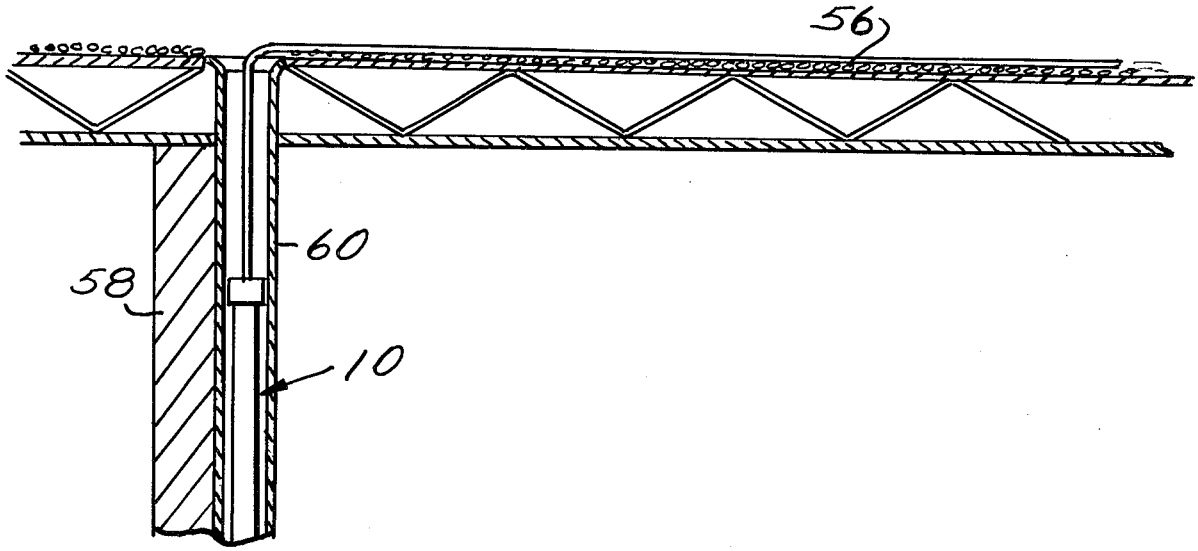
FIG. 2 is a view similar to FIG. 1 of a flat roof construction having a run-off system provided with a central downspout showing the device of the present invention mounted therein.

Referring now more particularly to FIGS. 1 and 2, there are illustrated therein two different flat roof cnstructions having different types of water run-off systems embodied therein within which the device 10 of the present invention is installed. In FIG. 1 there is shown a flat roof construction, generally indicated at 48, supported at one periphery by an outside wall 50. The water run-off system of the roof construction includes a peripheral side gutter 52 having a downspout 54 extending therefrom.

In FIG. 2 the roof has a flat construction, indicated at 56, with an interior vertical wall 58 supporting the same. Extending downwardly through the central portion of the roof construction 56 adjacent the interior vertical wall 58 is a downspout 60.

In both instances, the device 10 of the present invention is installed in the downspout, such as the downspout 54 or 60 of the embodiments of FIGS. 1 and 2 respectively. The downspout in both instances has a cross-sectional area which is considerably in excess of the cross-sectional area of the device 10. As shown, the mounting of the device 10 within the respective downspout is accomplished simply by lowering the same into the downspout by the hose 40 and allowing the hose to simply suspend the housing in a position disposed below the top of the downspout. The length of the hose is of a weight sufficient to prevent the housing from moving downwardly even when filled with water. However, the hose can be clamped or otherwise secured to insure against its downward movement. The free end of the hose is extended to the middle of the ponding area. The free end is simply positioned on the surface of the ponding area so that the openings 44 face generally downwardly and are in closely spaced relation with the surface of the ponding area without being blocked by the surface. This insures removal of a maximum amount of water from the ponding area.

So long as the ponding area is devoid of water, the device simply remains suspended within the downspout. When a rain condition commences and water is distributed to the flat roof construction, the majority of the water will be directed as run-off water in the run-off system, while a portion of the water will begin to build up as standing water in the ponding area. As the run-off water passes through the downspout, a portion of the water will be caught in the water receiving space 24 and enter the priming chamber 22 through inlet openings 28, inlet tube 26 and the lower inlet opening 30 thereof. As soon as this run-off water is made available to the inlet openings, there is established a rising water level condition with respect to the priming chamber 22.

So long as there is sufficient run-off water in the downspout to maintain the water receiving chamber 24 substantially filled, the amount of water passing into the priming chamber 22 through the inlet openings 28 and 30 will be greater than the amount of water passing out of the priming chamber 22 through the outlet opening 32. Since there is a net intake of water into the priming chamber 22, the water level therein will rise above the opening 30, thus trapping a column of air thereabove within the priming chamber 22 which communicates with the air vent tube 34 and hose 40. Check valve 38 allows this air to be displaced to the atmosphere by liquid displacement as the water level in the priming chamber 22 rises. The water level will rise until it reaches a level adjacent the upper partition wall 18 or, at most, to the upper level of the chamber 24. It will remain at this level so long as there is sufficient water in the run-off system to maintain the water receiving chamber 24 filled.

When the cessation of the rain condition occurs, the amount of run-off water passing through the downspout of the run-off system will decrease to an extent such that water receiving chamber 24 is no longer maintained in a filled condition so that the amount of water flowing through the outlet 32 will exceed the amount of water flowing through the inlet openings 28 from the water receiving chamber 24. When this occurs, there is established a lowering water level condition with respect to the priming chamber 22.

As the water level in the priming chamber 22 is lowered, liquid displacement occurs, which tends to increase the air space thereabove. This liquid displacement creates a negative pressure in the air above the water level, which negative air pressure is communicated with the interior of the air vent tube 34 and hose 40. Check valve assembly 38 in vent tube 34 prevents this negative pressure from being communicated to atmosphere through the air vent tube 34. Since the openings 44 in the free end of the hose are now covered with water standing in the ponding area, the reduced air pressure communicated with the interior of the hose 40 creates a suction through the openings 44 which causes water in the ponding area to be sucked through the openings and into the hose 40. As soon as sufficient water flows through the openings 44 to fill the interior of the hose to an extent such that there is a flow of water downwardly through the nipple 46 into the priming chamber 22, a siphoning action is established which will continue until all of the water in the ponding area has been sucked through the openings 44 and the siphoning action is discontinued by virtue of the flow of liquid in the hose sucking air through the openings 44.

In this way the device 10 is effective in its normal mode of operation to remove water which may accumulate in ponding areas on the roof immediately following the cessation of a rain condition which would otherwise create the standing water. It will be noted that after the completion of the siphoning action through the hose, any water remaining in the priming chamber 22 will simply run out of the outlet opening 32 so that the device 10 is completely drained of water. This is of significance during winter conditions where there may be intermittent periods of freezing.

It thus will be seen that the objects of this invention have been fully and effectively accomplished. It will be realized, however, that the foregoing preferred specific embodiment has been shown and described for the purpose of illustrating the functional and structural principles of this invention, and is subject to change without departure from such principles. Therefore, this invention includes all modifications encompassed within the spirit and scope of the following claims.

What is claimed is:

1. A method of removing water from a ponding area of a flat roof having a run-off system which is no longer operable to drain water from said ponding area which comprises the steps of utilizing a portion of the run-off water when flowing in said run-off system as a water source to prime a siphon device, siphoning the water from the ponding area with the siphon device so primed, and discharging the siphoned water into said run-off system.

2. A method as defined in claim 1 wherein said siphon device includes a housing defining a priming chamber therein mounted within the water run-off system at a vertical level below the vertical level of the ponding area of the flat roof and siphon hose means having an inlet end mounted in water sucking relation to the ponding area and an opposite end disposed in operative relation with said priming chamber such that negative pressure conditions within said priming chamber are communicated therewith, and wherein the portion of the run-off water utilized to prime the siphon device is directed into said priming chamber to establish a predetermined water level therein and said priming is accomplished by lowering the water level in said priming chamber by displacing water therefrom into said run-off system to thereby establish a negative pressure within the priming chamber which is communicated with said siphon hose means causing water from the ponding area to flow past the inlet end through the siphon hose means.

3. A method as defined in claim 2 wherein the establishment of the predetermined water level within said priming chamber is accomplished by directing a quantity of run-off water flowing in the run-off system as a result of the commencement of a rain condition or the like into said priming chamber while allowing the water in said priming chamber to discharge into the run-off system at a rate less than the rate of flow of run-off water into the priming chamber and wherein the lowering of the water level in said priming condition is accomplished as a result of the lessening of the flow in the run-off system as a result of the cessation of the rain condition or the like so that the quantity of water available to be directed into the priming chamber is less than the quantity of water flowing from the priming chamber.

4. A method for removing water from a ponding area of a flat roof having a run-off system which is no longer operable to drain water from the ponding area which comprises directing a quantity of the run-off water flowing in the run-off system as a result of the commencement of a rain condition or the like into a priming chamber, displacing water from the priming chamber back into the run-off system in such a way as to establish a negative pressure condition within the priming chamber, and communicating the negative pressure condition to an end of a siphon hose at a vertical level below the level of the ponding area, the other inlet end of which is disposed in water sucking relation to the ponding area to thereby prime the siphon hose and commence the flow of water from the ponding area which flow after the cessation of the rain condition or the like continues until the water is substantially removed from the ponding area.

* * * * *